US006012315A

United States Patent [19]

Sekido et al.

[11] Patent Number: 6,012,315

[45] Date of Patent: Jan. 11, 2000

[54] METHOD OF MANUFACTURING PIPE

[75] Inventors: Yutaka Sekido, Nagoya; Yasushi Kuniminato, Aichi-ken, both of Japan

[73] Assignee: Sango Co. Ltd., Nagoya, Japan

[21] Appl. No.: 08/869,956

[22] Filed: Jun. 5, 1997

[30] Foreign Application Priority Data

Jun. 6, 1996 [JP] Japan ..... 8-143363

[51] Int. Cl.[7] ..... B21D 39/02

[52] U.S. Cl. ..... 72/51

[58] Field of Search ..... 72/51, 52, 367.1, 72/368, 370.01; 29/890.03, 890.08, 890.045, 890.053, 890.054, 897, 897.33; 493/292, 303, 304, 305, 306

[56] References Cited

U.S. PATENT DOCUMENTS

| | | | |
|---|---|---|---|
| 2,401,542 | 6/1946 | Booth | 72/368 |
| 3,720,988 | 3/1973 | Waters | 29/157.3 |
| 4,709,472 | 12/1987 | Machida et al. | 242/444.1 |
| 4,719,679 | 1/1988 | Fukuda . | |
| 4,975,095 | 12/1990 | Strickland et al. | 242/444.1 |

FOREIGN PATENT DOCUMENTS

| | | |
|---|---|---|
| 341120 | 4/1927 | Belgium . |
| 1454335 | 9/1966 | France . |
| 2 031 904 | 1/1972 | Germany . |
| 61-008417 | 1/1986 | Japan . |
| 63-196425 | 12/1988 | Japan . |
| 4-006397 | 1/1992 | Japan . |
| 4-294835 | 10/1992 | Japan . |
| 7-325048 | 12/1995 | Japan . |

OTHER PUBLICATIONS

*Patent Abstracts of Japan*, vol. No. 007, No. 020, Jan. 26, 1983 & JP–57–175026, Oct. 27, 1982.

*Patent Abstracts of Japan*, vol. No. 017, No. 271, May 26, 1983 & JP–05–007965, Jan. 19, 1993.

*Primary Examiner*—Rodney Butler

*Attorney, Agent, or Firm*—Pillsbury Madison & Sutro LLP

[57] ABSTRACT

In order to manufacture a pipe having a plurality of flow channels, by minimizing die jigs and steps, and thus to permit facilitation of manufacture, reduction of cost, and improvement of accuracy, the method of manufacturing a pipe comprises the steps of holding a sheet material at a center portion in the width direction thereof from both surfaces thereof by core members composing a split structure, folding both sides in the width direction of the sheet material in opposite directions and causing the thus folded both sides of the sheet material to follow the shapes of the outer surfaces of the core members, thereby forming a substantially an S-shaped cross-section. In a preferred embodiment, the method comprises the steps of providing outer dies, each of which has a concave surface substantially identical with the outer surface of one of the core members, and folds one of both ends of the sheet material toward the outer surface of the core member by the outer die while moving the outer die toward the core member.

3 Claims, 6 Drawing Sheets

METHOD OF MANUFACTURING PIPE

BACKGROUND OF THE INVENTION

1. Field of the Invention

The present invention relates to a method of manufacturing a pipe.

2. Description of the Related Art

It is a conventional practice, in an automobile exhaust pipe or the like, to provide a partition plate in the pipe to make a plurality of parallel flow channels.

For the manufacture of such a pipe, there have conventionally been available a method of forcing a long plate-shaped partition plate into a cylinder, and a method of dividing a sheet type base plate into three in the width direction, and folding the base plate at both sides in opposite directions into an S-shaped cross-section so that the center portion of the base plate forms a partition plate, thereby providing a plurality of parallel flow channels, as disclosed, for example, in JP-U-63-196425, JP-A-04-6397 and JP-A-04-294835.

In the former manufacturing method, it is difficult to force a long partition plate into a long cylinder.

In the latter manufacturing method, a side of the base plate is first folded, and then the other side is folded, i.e., in different steps, both sides are folded, respectively. It is therefore necessary to use special die jigs such as exclusive inner dies and exclusive outer dies for folding the respective sides in the different steps, thus resulting in a longer manufacturing time and a higher manufacturing cost. In addition, necessity of replacing jigs and dies during an interval between the two folding steps may lead to occurrence of a working error, thus making it difficult to obtain an accurate sectional shape. This results in an unstable shape of the bent portion (weld joint) of the partition plate with which the leading end of the folded side comes into butt contact, thus leading to a decrease in welding quality.

The present invention has therefore an object to provide a method of manufacturing a pipe, which permits resolution of these problems.

SUMMARY OF THE INVENTION

To solve the foregoing problems, a first aspect of the present invention provides a method of manufacturing a pipe, comprising the steps of holding a sheet material at a center portion in a width direction thereof from both surfaces thereof by means of core members composing a split structure, folding both sides in the width direction of the sheet material in opposite directions and causing the thus folded both sides of the sheet material to follow the shapes of the outer surfaces of the core members, thereby forming a substantially an S-shaped cross-section.

A second aspect of the present invention provides the method of manufacturing a pipe according to the foregoing first aspect, wherein the method comprises the steps of folding both sides of the sheet material in opposite directions relative to the center portion in the width direction thereof, further folding the sheet material gradually from the sides thereof toward the center portion thereof while holding the sheet material from both surfaces at the center portion thereof by means of the core members, thereby causing both sides of the sheet material to follow the shapes of the outer surfaces of the core members.

A third aspect of the present invention provide the method of manufacturing a pipe according to the foregoing second aspect, wherein the method comprises the steps of providing outer dies, each of which has a concave surface substantially identical with the outer surface of one of the core members, and folds one of both ends of the sheet material toward the outer surface of the core member by means of the outer die while moving the outer die toward the core member.

A fourth aspect of the present invention provides the method of manufacturing a pipe according to the foregoing first aspect, wherein the method comprises the steps of folding both sides of the sheet material in opposite directions with respect to the center portion in the width direction thereof, holding the sheet material at the center portion thereof from both surfaces thereof by means of the core members, and folding both sides of the sheet material gradually from the center portion toward the ends thereof, thereby causing both sides of the sheet material to follow the shapes of the outer surfaces of the core members.

A fifth aspect of the present invention provides the method of manufacturing a pipe according to the foregoing fourth aspect, wherein both sides of the sheet material are wound on the core members by turning the core members in a direction around a center line passing through the split surface thereof, and at the same time, both sides are pressed against the outer surfaces of the core members, thereby causing both sides of the sheet material to follow the shapes of the outer surfaces of the core members.

A sixth aspect of the present invention provides the method of manufacturing a pipe according to the foregoing first or fourth aspect, wherein the method comprises the steps of rotatably providing the core members, providing on the outer surface sides of the core members pressing rollers, each of which rotates around a rotation axis running in parallel with a rotary shaft of the core members, and pressing both sides of the sheet material against the outer surfaces of the core members by means of the pressing rollers while rotating the core members which hold the sheet material.

A seventh aspect of the present invention provides the method of manufacturing a pipe according to the foregoing fourth aspect, wherein the method comprises the steps of rotatably providing the core members, pressing a flat surface of each of flat plates against one of the outer surfaces of both sides of the sheet material held by the core members, and moving the flat plate so that the core members rotate in the pressed state, thereby folding both sides of the sheet material toward the core members.

An eighth aspect of the present invention provides the method of manufacturing a pipe, comprising the steps of holding a side in a width direction of a sheet material by means of core members composing a split structure, and pressing another side of the sheet material against the outer surfaces of the core members while rotating the core members, thereby causing another side of the sheet material to follow the shapes of the core members and forming a e-shaped cross-section.

A ninth aspect of the present invention provides the method of manufacturing a pipe according to any one of the foregoing first to eighth aspects, wherein holes and/or notches used for attaching another member to the base plate before the folding step of the sheet material or as communicating holes are formed.

A tenth aspect of the present invention provides the method of manufacturing a pipe according to any one of the foregoing first to eighth aspects, wherein a projection is formed on an end face in the folding direction of the base plate before the folding step of the sheet material.

BRIEF DESCRIPTION OF THE DRAWINGS

FIG. 1A is a sectional side view of a base plate before folding; FIG. 1B is a sectional view of two core members holding a sheet material; FIG. 1C is a sectional side view illustrating a process in the middle of manufacture; FIG. 1D is a sectional side view illustrating completion of folding of the sheet material; and FIG. 1E is a sectional view of a product pipe welded after folding;

FIG. 5A is a sectional side view of core members holding a sheet material; and FIG. 5B is a side view illustrating a product pipe;

FIG. 6A is a perspective view of a product pipe; and FIG. 6B is a plan view of a sheet material comprising a sheet-type base plate having an attachment hole pierced therein;

FIG. 7A is a plan view of a sheet material comprising a sheet-type base plate having a hole and a notch formed therein; FIG. 7B is a plan view illustrating the sheet material folded into a pipe shape; FIG. 7C is an enlarged sectional view taken along the line VIIC—VIIC in FIG. 7B; FIG. 7D is a plan view illustrating formation of an additional connecting portion; and FIG. 7E is a sectional plan view illustrating the formed pipe in service; FIG. 8A is a plan view of a sheet material comprising a sheet-type base plate having a projection formed therein; FIG. 8B is a plan view of the sheet material folded into a pipe shape; FIG. 8C is an enlarged sectional view taken along the line VIIIC—VIIIC in FIG. 8B; and FIG. 8D is a plan view of a sheet material formed into a door impact beam.

DESCRIPTION OF THE PREFERRED EMBODIMENTS

Now, embodiments according to the present invention will be described below with reference to the drawings. FIGS. 1A to 1E illustrate a first embodiment of the present invention.

Figures 1A, 1B, 1C, 1D, 1E:
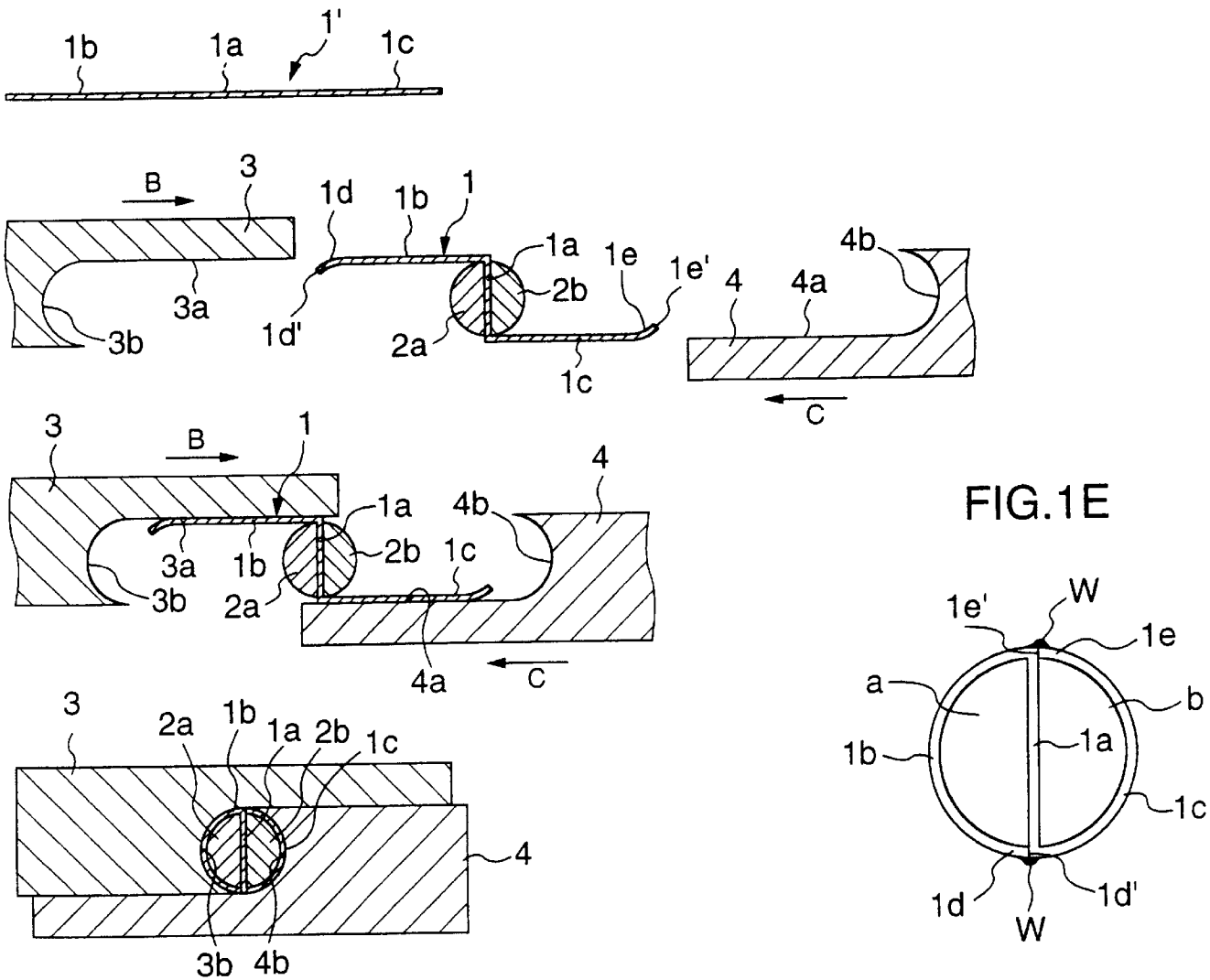
FIGS. 1A to 1E illustrate a first embodiment of the manufacturing method of the present invention.

In these drawings, 1' is a base plate forming a pipe, and a single flat sheet as shown in FIG. 1A having, prior to forming, prescribed length and width. In FIG. 1A, the right/left direction is the width direction of the sheet and the depth direction is the longitudinal one thereof. A pipe as shown in FIG. 1E having a partition plate 1*a*, a semi-circular first side plate 1*b* for forming a first flow channel a on one side of the partition plate 1*a*, and a semi-circular second side plate 1*c* for forming a second flow channel b on the other side is formed through the following steps.

The both sides 1*b* and 1*c* of the aforesaid flat sheet-shaped base plate 1' are first folded by about right angles in opposite directions relative to the center portion 1*a* thereof. The thus folded sheet material is represented in FIG. 1B. This center portion 1*a* forms the partition plate 1*a* in the above-mentioned FIG. 1E, and the length in the width direction thereof is set to a value equal to the diameter in FIG. 1E. The first side 1*b* forms the foregoing first side plate 1*b*, and the second side 1*c* forms the foregoing second side plate 1*c*. The length of these side plates in the width direction thereof is set to a value equal to the length of the portion of the leading end faces 1*d*' and 1*e*', after folding into prescribed shapes as shown in FIG. 1E, in contact with folded base portion of the partition plate. Simultaneously with the above-mentioned folded portions, leading end portions 1*d* and 1*e* of the both sides 1*b* and 1*c* are also folded into an arcuate shape toward the side including the center portion 1*a*.

Then, as shown in FIG. 1B, the center portion 1*a* is held with two core members 2*a* and 2*b* by interposing the center portion 1*a* of the sheet material 1 between flat surfaces of a core member 2*a* having a semi-circular cross-section and another core member 2*b* also having a semi-circular cross-section.

These core members 2*a* and 2*b* compose a split structure divided into two, moving from right to left or vice versa by means of respective opening/closing means not shown to open or close the gap between the flat surfaces of both core members 2*a* and 2*b* which are arranged opposite to each other. The center portion la is interposed between the both core members 2*a* and 2*b* by opening the same, and is held under pressure by closing the same.

While the core members 2*a*, 2*b* compose the split structure divided into two in this embodiment, the split structure may be divided into three or more.

The core members 2*a* and 2*b* holding the sheet material 1 therebetween as described above are kept fixed without rotating the same. In this state, outer dies 3 and 4 arranged on both sides in a horizontal direction of the drawing are moved in the core member direction (in the directions of arrows B and C). These right and left outer dies 3 and 4 have flat surfaces 3*a* and 4*a* flush with the extension surface (outer surfaces) of both sides 1*b* and 1*c* of the sheet material 1 held in the state shown in FIG. 1B, and die surfaces 3*b* and 4*b* comprising concave surfaces having substantially the same diameter (larger by the thickness of the sheet material 1) as the outer surface shape of the core members 2*a* and 2*b*, and corresponding to the core members 2*a* and 2*b*. The flat surfaces 3*a* and 4*a* run continuously to the die surfaces 3*b*and 4*b*. These outer dies 3 and 4 are movable forward and back in the directions of the arrows B and C and vice versa by means of driving means not shown.

When the outer dies 3 and 4 are moved from the state shown in FIG. 1B in the directions of the arrows B and C, the respective flat surfaces 3*a* and 4*a* slide from both ends of the sheet material 1 onto the outer surfaces of both sides 1*b* and 1*c* into the state shown in FIG. 1C.

Further, when the outer dies 3 and 4 are moved in the directions of the arrows B and C while fixing the core members 2*a* and 2*b*, both ends of the sheet material 1 engage with the die surfaces 3*b* and 4*b*. Then, following the ends, the sides 1*b* and 1*c* are sequentially guided by the die surfaces 3*b* and 4*b*, thus folding sequentially both side plates 1*b* and 1*c* from the ends toward the center portion 1*a*.

When the outer dies 3 and 4 reach the foremost positions so that both die surfaces 3*b* and 4*b* hold both sides of the core members 2*a* and 2*b* therebetween as shown in FIG. 1D, the sides 1*b* and 1*c* are folded so as to follow the shape of the outer surfaces of the core members 2*a* and 2*b* as shown in FIG. 1D by means of the die surfaces 3*b* and 4*b*, and plastically deform in this state. As a result, the leading end face 1*d*' of one side comes into contact with one of the folding bases of the center portion (partition plate) 1*a*, and the leading end face 1*e*' of another side comes into contact with another folding base of the center portion (partition plate) 1*a*, thus forming an S shape.

By previously folding the leading ends 1*d* and 1*e* of both sides 1*b* and 1*c* as shown in FIGS. 1B and 1C, the sides 1*b* and 1*c* are, when the outer dies 3 and 4 move to the outer surfaces of the sides 1*b* and 1*c* as shown in FIGS. 1B and 1C, guided smoothly by the die surfaces 3*b* and 4*b* because of the folded leading ends 1*d* and 1*e*, and the outer dies 3 and 4 never come into contact with the leading end faces 1*d*' and 1*e*'. By previously folding the leading ends 1*d* and 1*e*, furthermore, there is available an improved butt contact between the leading end faces 1*d*' and 1*e*' with the folding base of the center portion 1*a*.

After folding as shown in FIG. 1D, the outer dies 3 and 4 are caused to retreat in the directions counter to the respective arrows, and the formed sheet material 1 is pulled out from the core members 2*a* and 2*b* by slightly opening the core members 2*a* and 2*b*. The leading end faces 1*d*' and 1*e*' of the formed product thus pulled out are welded together by welding W with the folded base of the center portion 1*a* to form a pipe having two parallel flow channels a and b as shown in FIG. 1E.

According to the first embodiment, it is possible to fold the sides 1*b* and 1*c* at the same time while clamping the sheet material 1 at the center portion thereof with the core members 2*a* and 2*b*. This ensures easier manufacture. Since the core members 2*a* and 2*b* holding the sheet material 1 directly serve as inner dies, die jigs can be omitted. The final state after causing the sheet material 1 to follow the shape of the core members 2*a* and 2*b* directly serves as the desired cross-section. It is therefore possible to achieve a high shape accuracy, eliminate the necessity of shape correction, and ensure a high welding quality.

When forming concave die surfaces 3*b* and 4*b* on the outer dies 3 and 4 as in this first embodiment, the sheet material 1 is secured by inner dies comprising the core members 2*a* and 2*b* and outer dies comprising the die surfaces 3*b* and 4*b*. A particularly high shape accuracy is therefore available. Further, by forming the outer surface shape of the core members 2*a* and 2*b* and the inner surface shape of the die surfaces 3*b* and 4*b* into a desired shape, apart from the true circular cross-section in the embodiment shown, it is possible to form a pipe of any desired shape including an elliptical or rectangular shape.

In the present embodiment, therefore, the outer surface shape of the core members 2*a* and 2*b* and the inner surface shape of the die surfaces 3*b* and 4*b* are not limited to the semi-circular one as shown in the drawings.

Figure 2:
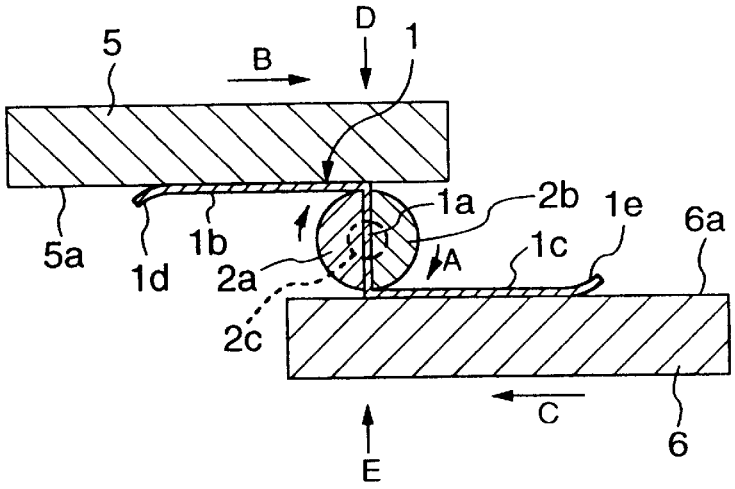
FIG. 2 is a sectional side view illustrating a second embodiment of the manufacturing method of the present invention.

FIG. 2 illustrates a second embodiment of the present invention.

In the second embodiment, the core members 2*a* and 2*b* in the foregoing first embodiment are provided on a rotary shaft 2C rotatably around the rotation shaft 2*c*, which rotates around the center line passing through the split surface, and outer dies 5 and 6 having flat surfaces 5*a* and 6*a* similar to those of the outer dies 3 and 4 in the foregoing first embodiment movably in the arrow B and C directions and vice versa.

In the second embodiment, both sides 1*b* and 1*c* in the width direction of the same base plate 1' as above are first folded in opposite directions relative to the center portion 1*a* (the leading ends 1*d* and 1*e* are folded at the same time) in the same manner as in the foregoing first embodiment to form a sheet material 1. Then, the sheet material 1 is held by the core members 2*a* and 2*b* at the center portion 1*a* of the sheet material as shown in FIG. 2, and the outer dies 5 and 6 are moved forward in the directions of the arrows B and C as in the first embodiment.

At the moment when the leading ends of the outer dies 5 and 6 reach the center portion 1*a* of the sheet material 1, the outer dies 5 and 6 are moved forward in the directions of the arrows B and C while pressing the outer dies 5 and 6 by pressing means not shown in the directions of the arrows D and E toward the core members 2*a* and 2*b*. As a result, frictional force produced between the flat surfaces 5*a* and 6*a* of the outer dies 5 and 6 and the outer surfaces of the sides 1*b* and 1*c* of the sheet material 1 causes the core members 2*a* and 2*b* to rotate while following in the arrow A direction. Along with this rotation, the sides 1*b* and 1*c* of the sheet material are wound on the outer surfaces of the core members 2*a* and 2*b*, and at the same time, are pressed against the outer surfaces of the core members 2*a* and 2*b* by the flat surfaces 5*a* and 6*a*, following the outer surface of the core members 2*a* and 2*b* through plastic deformation, and are thus formed into an S-shaped cross-section as in FIG. 1D.

The outer dies 5 and 6 are retreated, and the formed product is taken out from the core members 2*a* and 2*b* by slightly opening the core members 2*a* and 2*b*, thereby forming a pipe having a plurality of flow channels by welding W in the same manner as in FIG. 1D.

In this second embodiment, the both sides 1*b* and 1*c* can simultaneously be folded while clamping the sheet material 1 at the center portion thereof by means of the core members 2*a* and 2*b*, thus permitting easy manufacture. The core members 2*a* and 2*b* holding the sheet material 1 directly serving as the inner die eliminate the necessity of die jigs. The final state after causing the sheet material 1 to follow the shape of the core members 2*a* and 2*b* constitutes the desired cross-sectional shape itself, resulting in a high shape accuracy, making it unnecessary to conduct shape correction, and permitting maintenance of a high welding quality.

By forming the outer surface shape of the core members 2*a* and 2*b* into a desired shape, it is possible to form a pipe of any desired shape such as an elliptic or rectangular cross-sectional shape, apart from the true circular shape in the embodiment shown in the drawing.

Figure 3:
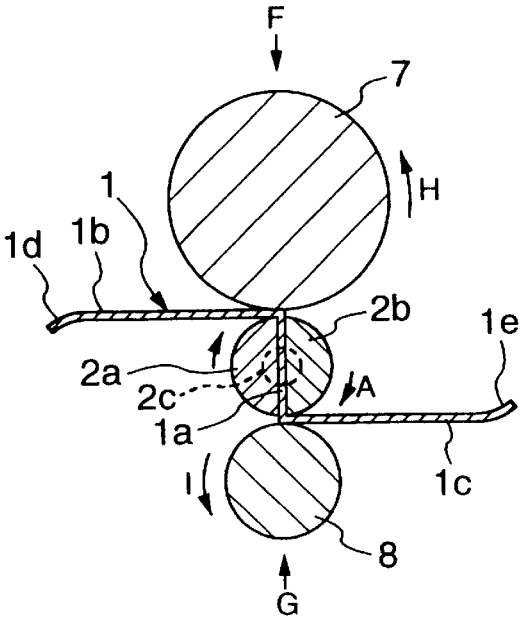
FIG. 3 is a sectional side view illustrating a third embodiment of the manufacturing method of the present invention.

FIG. 3 illustrates a third embodiment of the present invention.

In the third embodiment, core members 2*a* and 2*b* are provided rotatably as in the second embodiment, and pressing rollers 7 and 8 having rotation axes in parallel with the rotary shaft 2*c* of the core members 2*a* and 2*b* are provided on the outer peripheral surfaces of the core members 2*a* and 2*b*. The pressing rollers 7 and 8 are provided with rotation means and pressing means not shown, and rotate in the directions of the arrows H and I while being pressed against the core members 2*a* and 2*b* in the directions of the arrows F and G.

In this embodiment, a sheet material is first prepared by folding the both sides 1*b* and 1*c* in the width direction of a base plate relative to the center portion 1*a* thereof in the opposite directions in the same manner as in the foregoing first embodiment (leading end 1*d* and 1*e* are simultaneously folded). Then, the sheet material 1 is held by core members 2*a* and 2*b* at the center portion 1*a* as shown in FIG. 3.

By rotating the pressing rollers 7 and 8 from the state shown in FIG. 3 while pressing in the directions of arrows F and G, the core members 2*a* and 2*b* rotate in the arrow A direction while following the shape, and simultaneously with the completion of winding of the sides 1*b* and 1*c* of the sheet material 1 onto the outer surface of the core members 2*a* and 2*b*, the sheet material is pressed by the pressing rollers 7 and 8 against the outer surfaces of the core members 2*a* and 2*b*, plastically deforms into a shape following the outer surfaces of the core members 2*a* and 2*b*, and is formed into an S-shaped cross-section as in FIG. 1D.

Then, the pressing rollers 7 and 8 are caused to retreat in directions counter to the arrow directions, and the formed product is taken out from the core members 2*a* and 2*b* by slightly opening the core members 2*a* and 2*b*. A pipe having a plurality of flow channels is formed by welding in the same manner as in FIG. 1D.

According to this third embodiment, it is possible to fold the sides 1*b* and 1*c* at the same time while clamping the sheet material 1 at the center portion thereof with the core members 2*a* and 2*b*. This ensures easier manufacture. Since the core members 2*a* and 2*b* holding the sheet material 1 directly serve as inner dies, die jigs can be omitted. The final state after causing the sheet material 1 to follow the shape of the core members 2*a* and 2*b* directly serves as the desired cross-section. It is therefore possible to achieve a high shape accuracy, eliminate the necessity of shape correction, and ensure a high welding quality.

In this embodiment, furthermore, it is recommendable to provide the pressing rollers 7 and 8 movably (vertically in FIG. 3) with an adjustable distance between the rollers (pitch) and to provide the core members 2*a* and 2*b* replaceable with one of a different kind.

In such a configuration, the pressing rollers 7 and 8 can rotate while following the outer surfaces of the core members 2*a* and 2*b* by only replacing the core members 2*a* and 2*b* with ones having desired diameter and outer shape, and it is possible to easily cope with a case of forming a pipe of a different diameter or a different outer shape. This embodiment is therefore suitable for the manufacture of many different pipes which usually requires frequent replacement of setup.

Figure 4:
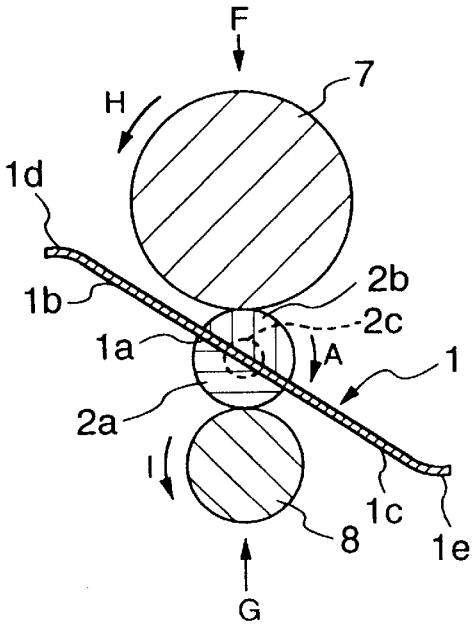
FIG. 4 is a sectional side view illustrating a fourth embodiment of the manufacturing method of the present invention.

FIG. 4 illustrates a fourth embodiment of the present invention.

The fourth embodiment has the same configuration as that of the third embodiment except that the center portion 1*a* and the both sides 1*b* and 1*c* of the sheet material 1 are not folded, but are held by the core members 2*a* and 2*b* in the form of a flat sheet and then folded for forming. The core members 2*a* and 2*b* and the pressing rollers 7 and 8 are configured in the same manner as in the third embodiment.

In the fourth embodiment, when the pressing rollers 7 and 8 are pressed and rotated in the directions of arrows H and I, the core members 2*a* and 2*b* rotate in the arrow direction of A, following the pressing rollers 7 and 8, so that the sides 1*b* and 1*c* of the sheet material 1 are wound on the outer surfaces of the core members 2*a* and 2*b*, and at the same time, the pressing rollers 7 and 8 press the same against the outer surfaces of the core members 2*a* and 2*b*. The sheet material 1 thus plastically deforms, following the shape of the outer surfaces of the core members 2*a* and 2*b*, and is formed into an S-shaped cross-section in the same manner as in FIG. 1D.

In this fourth embodiment as well, the effects similar to those available in the third embodiment are displayed, permitting elimination of the step of once folding the sides 1*b* and 1*c* as in the foregoing embodiments. Also in this embodiment, the core members 2*a* and 2*b* should have any desired diameter and outer shape.

Figure 5A:
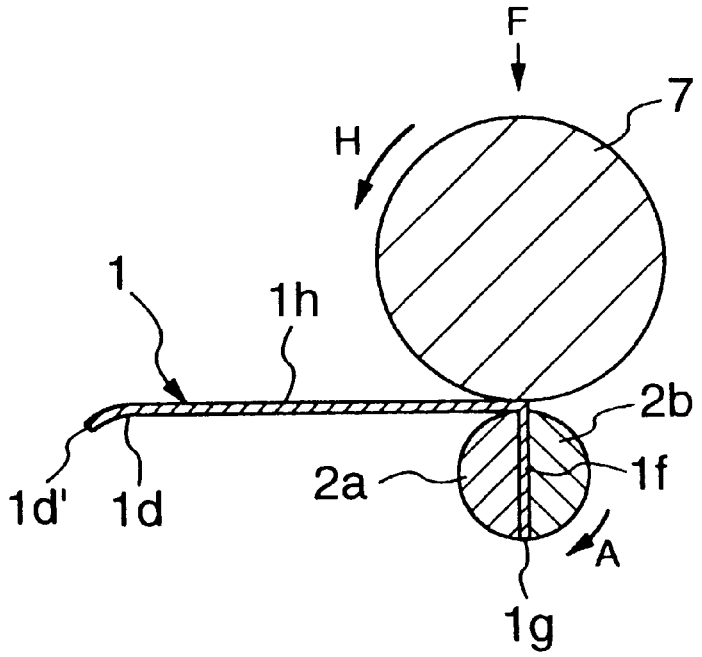
FIGS. 5A and 5B illustrate a fifth embodiment of the manufacturing method of the present invention.
Figure 5B:
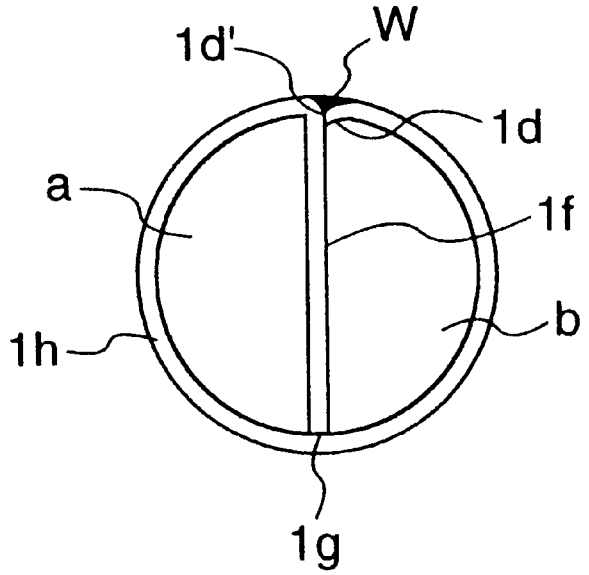

FIGS. 5A and 5B illustrate a fifth embodiment of the present invention.

The fifth embodiment represents a method of forming a pipe having a plurality of flow channels by folding a sheet material 1 into a e shape.

In FIGS. 5A and 5B, the core members 2*a* and 2*b* and the pressing roller 7 have the same configuration as in the third embodiment.

A side 1*f* in the width direction of a base plate is previously folded, and the side 1*f* of the sheet material 1 is held by the core members 2*a* and 2*b* so that an end 1*g* of this side 1*f* is flush with the outer peripheral surfaces of the core members 2*a* and 2*b* as shown in FIG. 5A. Then, the pressing roller 7 is rotated in the arrow H direction while pressing the pressing roller 7 against the core members 2*a* and 2*b* as indicated by the arrow F.

As a result, the core members 2*a* and 2*b* rotate in the arrow A direction by following, and the other side 1*h* of the sheet material 1 is continuously wound onto the entire outer peripheral surfaces of the core members 2*a* and 2*b*. At the same time, the same is pressed by the pressing roller 7 against the outer surfaces of the core members 2*a* and 2*b*, plastically deforming to follow the outer surface shapes of the core members 2*a* and 2*b*, and thus, being formed into an ø-shaped cross-section as shown in FIG. 5B.

Then, an end face 1*d*' is welded W together with the folding base portion of the side 1*f* to form a pipe having a plurality of flow channels a and b as shown in FIG. 5B.

In the fifth embodiment also, the same effects as in the foregoing second embodiment are available. The core members 2*a* and 2*b* should have desired diameter and outer shape as in the preceding embodiment.

Figure 6A:
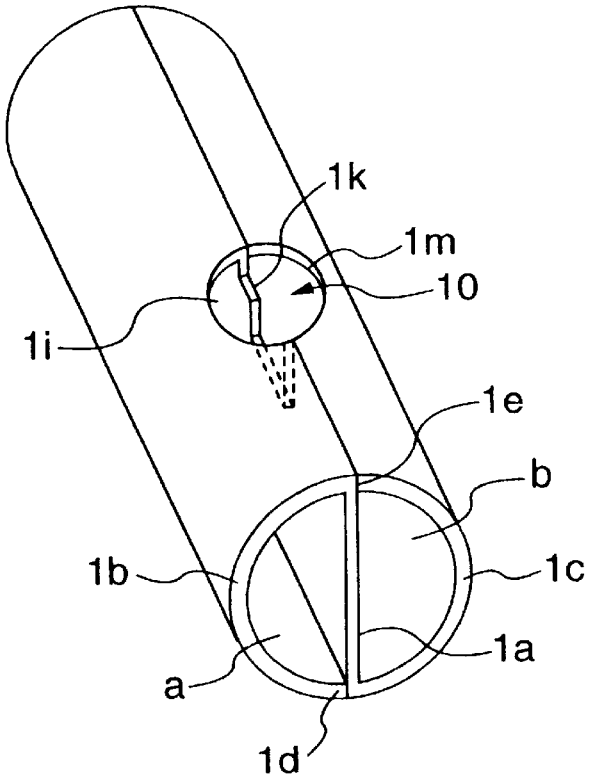
FIGS. 6A and 6B illustrate a sixth embodiment of the present invention.
Figure 6B:
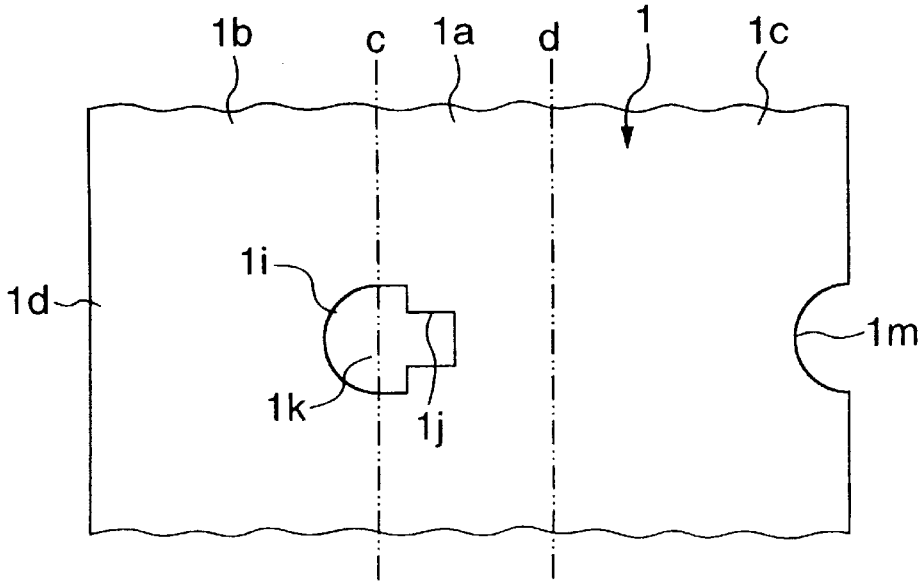

FIGS. 6A and 6B illustrate a sixth embodiment of the present invention.

In the sixth embodiment, when manufacturing an automobile exhaust pipe having attachment holes for an $O_2$ sensor and the like pierced in a part thereof, the pipe is formed by the application of any one of the manufacturing methods of the foregoing embodiments.

First, before folding a base plate 1', a hole 1*k* consisting of a semi-circular hole 1*i* and a stepped hole 1*j* as shown in FIG. 6B is stamped in the base plate 1' at a folded portion C between the center portion 1*a* and the side 1*b* thereof, and a notch 1*m* comprising a semi-circular hole as shown in FIG. 6B is stamped in the end face of another side 1*c*.

Then, this sheet material 1 is folded into an S-shaped cross-section as in the preceding embodiment, and a pipe is formed by aligning the holes 1*i* and 1*m*.

As a result, a hole 10 having two flow channels a and b, opening to these flow channels a and b, and having a notch in a partition plate 1*a* is formed as shown in FIG. 6A.

According to this embodiment, therefore, a hole of a complicated shape such as an attachment hole can be easily formed in the state of a flat sheet. More specifically, as compared with the conventional practice of providing such a hole 10 separately in a pipe and in a partition plate by end milling after forming the pipe, it becomes very easy to form an attachment hole. When forming such a hole 10 into the one in the embodiment shown in FIGS. 5A and 5B, it suffices to form the holes 1*k* and 1*j* as described above at a folded portion between a side 1*f* and the other side 1*h* in FIG. 5A, and form the aforesaid notch 1*m* on the end 1*d*' side.

FIGS. 7A to 7E illustrate a seventh embodiment of the present invention.

This embodiment covers a case where an exhaust pipe having flow channels a and b on the both sides of a partition wall 1*a* as described above has a communicating hole communicating the two flow channels a and b, provided in the partition wall 1*a*, and such an exhaust pipe is formed by the application of any one of the methods of the foregoing embodiments.

Figure 7A:
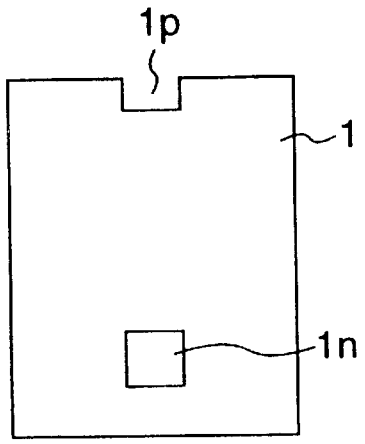
FIGS. 7A to 7E illustrate a seventh embodiment of the present invention.

First, as shown in FIG. 7A, a hole in is formed in a center portion which would serve as a partition wall during forming, in a base plate 1' before folding. In case of necessity, a notch 1*p* is formed in the center portion on the side which would serve as an end of the pipe after forming.

Figure 7B:
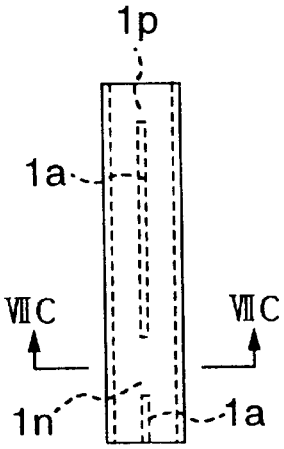
Figure 7C:
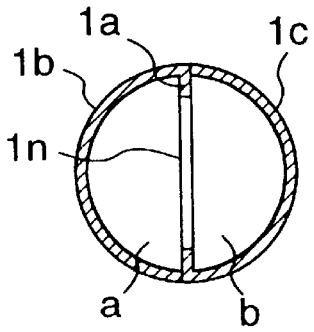

Then, the sheet material 1 is folded by the manufacturing method of any of the first to fourth embodiments into an S-shaped cross-section as shown in FIGS. 7B and 7C. Thus, an exhaust pipe having flow channels a and b on both sides of the partition wall 1*a* and a communicating hole in communicating both flow channels a and b, and formed in the partition wall 1*a*, is formed.

Figure 7D:
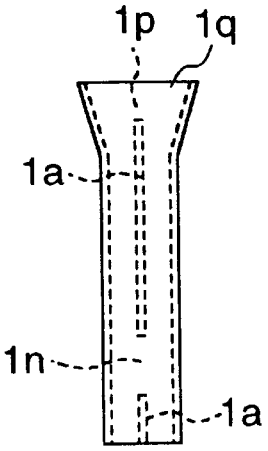
Figure 7E:
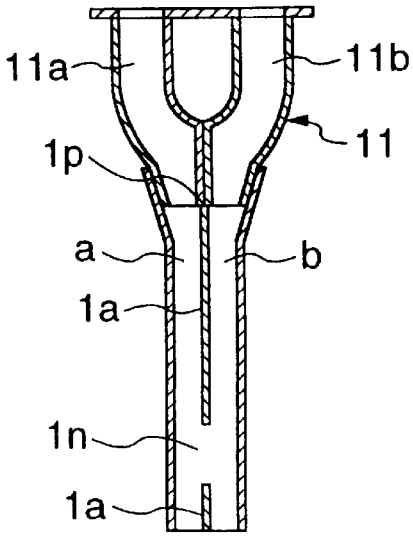

Further, in case of necessity, the diameter at the end on the notch 1*p* side is enlarged to form a connecting portion 1*q* as shown in FIG. 7D. The thus formed connecting portion 1*q* of the exhaust pipe manufactured as described above is connected to an engine exhaust manifold 11 as shown in FIG. 7E, and two exhaust pipes 11*a* and 11*b* of the exhaust manifold 11 are independently communicated with the flow channels a and b of the thus manufactured exhaust pipe.

Incidentally, a pipe may be formed by shifting the forming positions of the aforesaid hole 1*s* and the notch 1*p* and folding the sheet material 1 by the manufacturing method shown in FIG. 5A and 5B.

FIGS. 8A to 8D illustrate an eighth embodiment of the present invention.

This embodiment covers a case where an automobile door impact beam is formed by the application of the manufacturing method shown in FIGS. 5A and 5B.

Figure 8A:
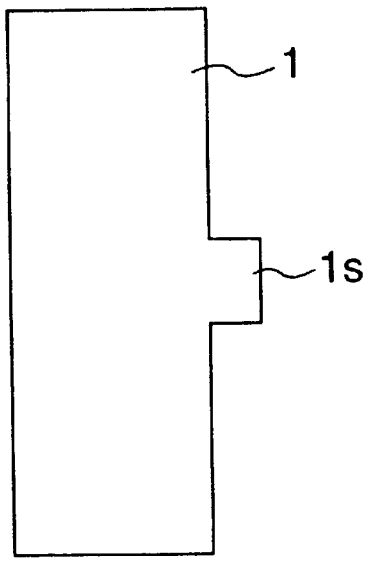
FIGS. 8A to 8D illustrate an eighth embodiment of the present invention.
Figure 8C:
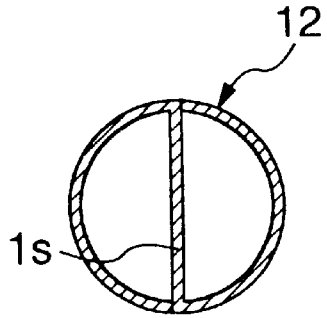
Figure 8B:
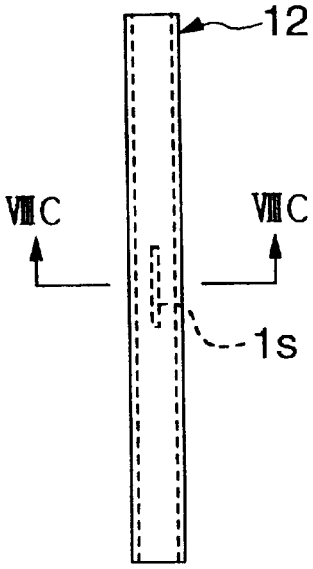

A sheet material 1 having a projection 1*s* at a side end thereof as shown in FIG. 8A is formed from a base plate 1' before folding. The projection 1*s* is held by core members 2*a* and 2*b* as shown in FIGS. 5A and 5B by the application of the manufacturing method shown in FIGS. 5A and 5B, and the sheet 1 is folded in the manner as described with reference to FIGS. 5A and 5B. As a result, the portion containing the projection (partition wall) is 1*s* formed into a ø-shaped cross-section, and the other portion is formed into a pipe 12 not containing the projection (partition wall) 1*s*.

Figure 8D:
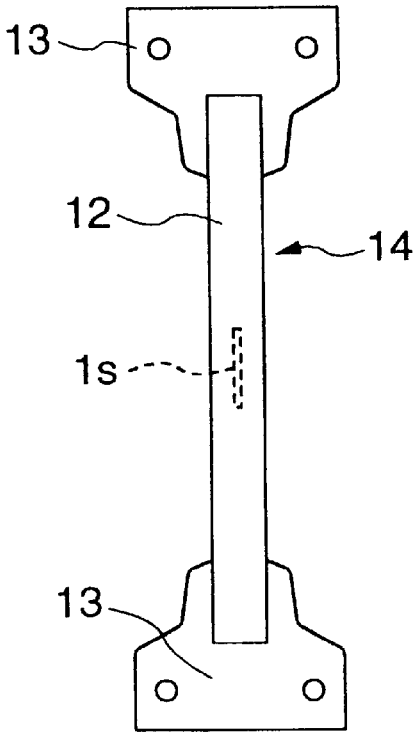

A door impact beam 14 is formed by providing an attachment piece 13 as shown in FIG. 8D on each of the both ends of the pipe 12.

According to this manufacturing method, it is possible to form a door impact beam light in weight which has a sufficient strength, in which only the center portion requiring a satisfactory bending rigidity is reinforced with the projection (partition wall) 1*s*, with the other portion having no partition wall.

The foregoing embodiments cover cases of forming a true circular pipe. It is however possible to manufacture a pipe having any desired outer shape and a plurality of flow channels with the same effects as above by forming the core members 2*a* and 2*b* and the die surfaces 3*b* and 4*b* into a special shape such as an elliptic or rectangular shape, or changing the diameter. The present invention is not therefore limited to the shapes of the core members 2*a* and 2*b* and the die surfaces 3*b* and 4*b* as in the foregoing embodiments.

Furthermore, it is needless to mention that the present invention is applicable not only to an automobile exhaust pipe and a door impact beam as described above, but also for the manufacture of other pipes.

According to the first and second aspects of the present invention, as described above, it is possible to form a pipe having a plurality of flow channels by folding the both sides of the sheet material at a time in the state in which the sheet material is clamped at the center portion by the core members. It is therefore possible, as compared with the conventional manufacturing method, to omit die jigs and steps, simply manufacture, and reduce the cost. The final state after causing the sheet material to follow the shape of the core members directly serves as the desired cross-section. It is therefore possible to achieve a high shape accuracy, eliminate the necessity of shape correction, and ensure a high welding quality.

According to the third aspect of the present invention, the both sides of the sheet material are constrained in a pressure-squeezing manner for folding/forming by the inner dies comprising the core members and the outer dies comprising concave surfaces. It is therefore possible to further improve the shape accuracy and form a pipe of a desired shape such as an elliptic or rectangular shaped cross-section in addition to the true circular cross-section, easily and at a high accuracy.

The fourth and fifth aspects of the present invention permit display of the same effects as in the foregoing invention as the first aspect.

According to the sixth aspect of the present invention, it is possible to easily cope with manufacture of various pipes with different diameters and outer shapes by providing different core members having different diameters and outer shapes and converting the same into desired values, making adjustable the distance between pressing rollers, or causing the pressing rollers to follow the outer shape of the core members. It is therefore useful for manufacture of many different kinds of pipes which requires frequent change in setup.

According to the seventh aspect of the present invention, the same effects as in the foregoing first aspect with simple equipment and configuration.

According to the eighth aspect of the present invention, a pipe having a plurality of flow channels with a ø-shaped cross-section can be manufactured while fully displaying the same effects as in the first aspect.

According to the ninth aspect of the present invention, it is possible to easily form a pipe having a plurality of flow channels as described above, in which there are formed attachment holes for other parts and communicating holes for communicating between the plurality of flow channels, with the same effects as above.

According to the tenth aspect of the present invention, it is possible to easily form a pipe having a reinforcing wall at a portion requiring reinforcement in the form of a projection.

What is claimed is:

1. A method of manufacturing a pipe, comprising the steps of:

folding both sides of a sheet material in opposite directions relative to a center portion in a width direction of said sheet material, holding the sheet material from both surfaces at the center portion of said sheet material by means of core members composing a split structure, moving toward the core members outer dies, each of which has a concave surface substantially identical with an outer surface of said core member, and folding both sides of the sheet material toward the outer surface of the core member by means of said outer die, thereby causing both sides of the sheet material to follow the shapes of the outer surfaces of the core members.

2. A method of manufacturing a pipe according to claim 1, further comprising forming at least one of holes and notches used for attaching another member to a base plate before the folding step of the sheet material or as communicating holes.

3. A method of manufacturing a pipe according to 1, further comprising forming a projection on an end face of a base plate, which end face is a starting end in the folding step, before the folding step of the sheet material.

* * * * *